United States Patent [19]

Watanabe

[11] Patent Number: 4,815,173

[45] Date of Patent: Mar. 28, 1989

[54] OPEN-FACED BUTTON

[75] Inventor: Hirokazu Watanabe, Kurobe, Japan

[73] Assignee: Yoshida Kogyo K. K., Tokyo, Japan

[21] Appl. No.: 101,645

[22] Filed: Sep. 28, 1987

[30] Foreign Application Priority Data

Sep. 29, 1986 [JP] Japan ..... 61-149277[U]

[51] Int. Cl.[4] ..... A44B 1/42

[52] U.S. Cl. ..... 24/90 R; 24/95; 24/113 R

[58] Field of Search ..... 24/90 R, 92, 94, 95, 24/113 R, 113 MP

[56] References Cited

U.S. PATENT DOCUMENTS

| | | | |
|---|---|---|---|
| 1,765,055 | 6/1930 | Carr . | |
| 2,442,362 | 6/1948 | Janes | 24/95 |
| 2,451,487 | 10/1948 | Huelster . | |
| 2,622,291 | 12/1952 | Drell . | |
| 3,320,644 | 5/1967 | Daddona, Jr. | 24/95 |
| 4,512,063 | 4/1985 | Fukuroi | 24/113 R |
| 4,570,307 | 2/1986 | Kanazaka | 24/94 |
| 4,571,780 | 2/1986 | Fukuroi | 24/94 |
| 4,607,415 | 8/1986 | Fukuroi | 24/92 |

FOREIGN PATENT DOCUMENTS 59-15610 10/1984 Japan .

*Primary Examiner*—Victor N. Sakran

*Attorney, Agent, or Firm*—Hill, Van Santen, Steadman & Simpson

[57] ABSTRACT

An open-faced button includes a button body having an annular reinforcement plate disposed between an annular flange of a button back and an annular cap so as to prevent undesirable deformation of the annular flange which would otherwise occur when a tack is staked into the button body to attach the latter to a garment fabric.

8 Claims, 4 Drawing Sheets

PRIOR PROBLEM

OPEN-FACED BUTTON

BACKGROUND OF THE INVENTION

1. Field of the Invention

The present invention relates to an open-faced button for attachment to jeans or other garment fabrics.

2. Prior Art

There have been proposed open-faced buttons which include, as shown in FIG. 6 of the accompanying drawings, a button body 7 having a button back 8 composed of a tubular stem 9 and an annular flange 10 extending outwardly from an upper end of the stem 9, and a cap 11 having a central aperture 12 and firmly fitted over an outer peripheral edge of the flange 10. The button body 7 is attached to a garment fabric C by staking a tack 13 through the garment fabric C into the button body 7 by means of a cooperating pair of punch and die P, D.

The open-faced button of the foregoing construction has a drawback that since there is a hollow space defined between the annular flange 10 and the cap 11, an inner peripheral edge 14 of the annular flange 10 is deformed or bent upwardly toward the cap 11 due to forces applied to the button body 7 when a shank of the tack 13 is driven through the garment fabric C into the button body 7. With this deformation of the annular flange 10, the tubular stem 9 is displaced upwardly away from the garment fabric C with the result that the shank has an effective length insufficient to spread over the upper end of an inner tube 15 when it is staked against the punch P to join the button body 7 with the tack 13. When staked, the shank having such insufficient effective length is forged into the inner tube 15 and then spreads the latter radially outwardly. The tack 13 thus attached is readily removed from the button body 7 when subjected to pulling force while the button is in use.

SUMMARY OF THE INVENTION

With the foregoing difficulties in view, an object of the present invention is to provide an open-faced button having a button body which is structurally rigid and hence can be attached reliably and neatly to a garment fabric without causing undesirable deformation when a tack is staked into the button body to attach the latter to the garment fabric.

According to the present invention, an open-faced button includes a button back having an annular reinforcement plate disposed between an annular flange of a button back and an annular cap for reinforcing the button body to prevent objectionable deformation of the annular flange which would otherwise occur when a tack in staked into the button body. Preferably, the reinforcement plate is formed from a sheet of metal having a thickness smaller than the spacing between the cap and the annular flange and includes a plurality of radial reinforcement ribs held in contact with the annular flange. Each of the reinforcement ribs has a protuberance preferably held in contact with an inner peripheral edge of the annular flange to reinforce the inner peripheral edge on which forces are concentrated when the tack is forced into the button body.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
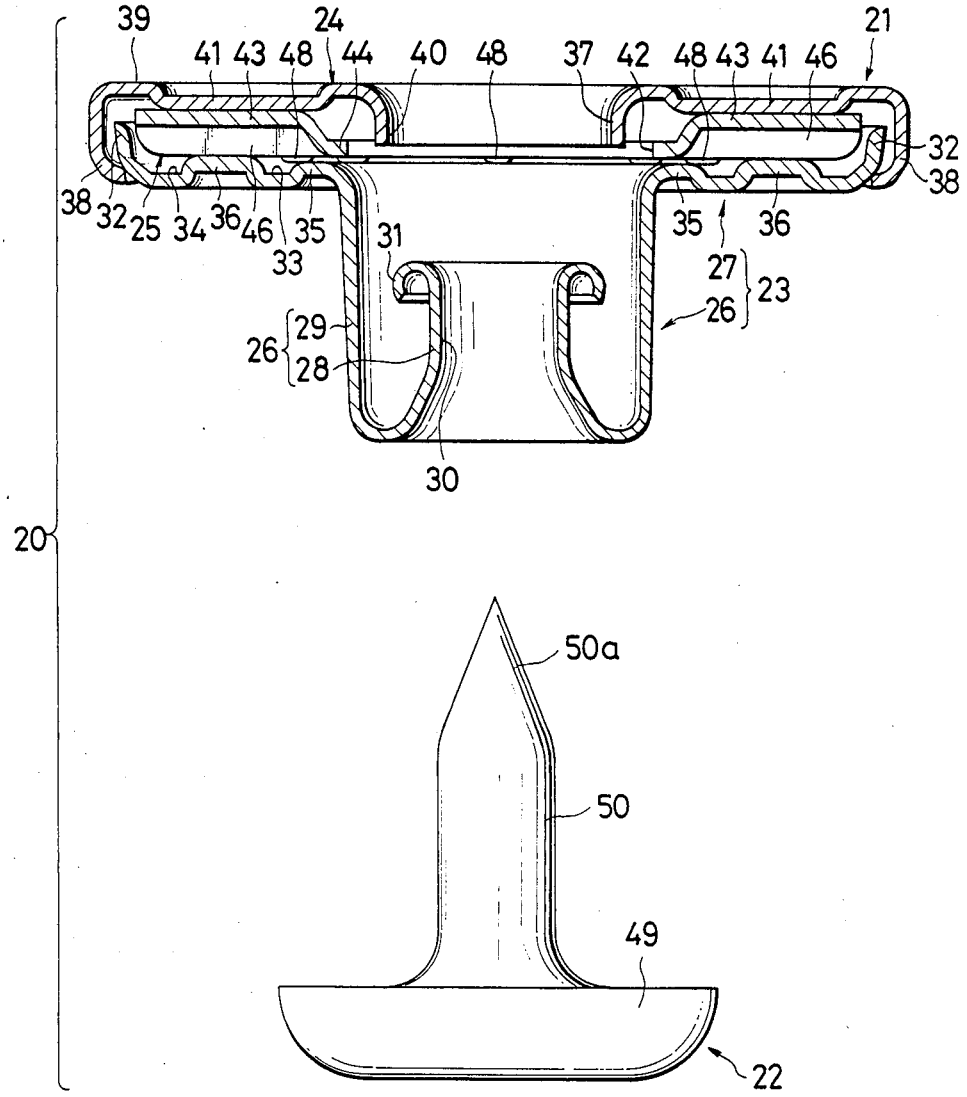
FIG. 1 is an exploded axial cross-sectional view of an open-faced button embodying the present invention, the button including a button body and a tack.

The principles of the present invention are particularly useful when embodied in an open-faced tack button 20 as shown in FIG. 1. The button 20 is composed of a button body 21 and a tack 22 to be assembled together to attach the button 20 to a garment fabric.

The button body 21 comprises a button back 23, a cap 24 mounted thereon, and a reinforcement plate 25 disposed between the button back 23 and the cap 24.

The button back 23 includes a hollow, double-walled tubular stem 26 having an integral annular flange 27 extending radially outwardly from an upper end of the tubular stem 26. The double-walled tubular stem 26 comprises an inner tube 28 and an outer tube 29 spaced radially outwardly from the inner tube 28 and joined thereto by a flat bottom wall of the stem 26. The inner tube 28 difines a longitudinal hole 30 for receiving a shank of the tack 22 as described later and includes an upper annular rim 31 arcuately curled radially outwardly and downwardly toward the bottom wall of the stem 26. The annular flange 27 extends radially outwardly from an upper end of the outer tube 29 and terminates in an upwardly bent outer peripheral edge 32. The annular flange 27 includes a pair of inner and outer annular grooves 33, 34 radially spaced from each other in concentric relation. The annular groove 33 and the upper end of the outer tube 29 define an annular ridge 35 therebetween, and the annular grooves 33, 34 define an annular land 36 therebetween. The land 36 extends in a level slightly higher than the level of the ridge 35.

The cap 24 has an annular shape and includes a pair of downwardly bent inner and outer peripheral edges 37, 38 and a flat annular top wall 39 extending between the peripheral edges 37, 38. The inner edge 37 defines a central aperture 40 having a diameter slightly larger than the diameter of a punch (described later). The outer edge 38 is firmly fitted over the outer edge 32 of the annular flange 27. The annular top wall 39 is recessed in its face so as to provide an inwardly projecting annular land 41 facing the annular flange 27. The land 41 overlies the ridge 35, groove 33, land 36 and groove 34 of the annular flange 27.

Figure 2:
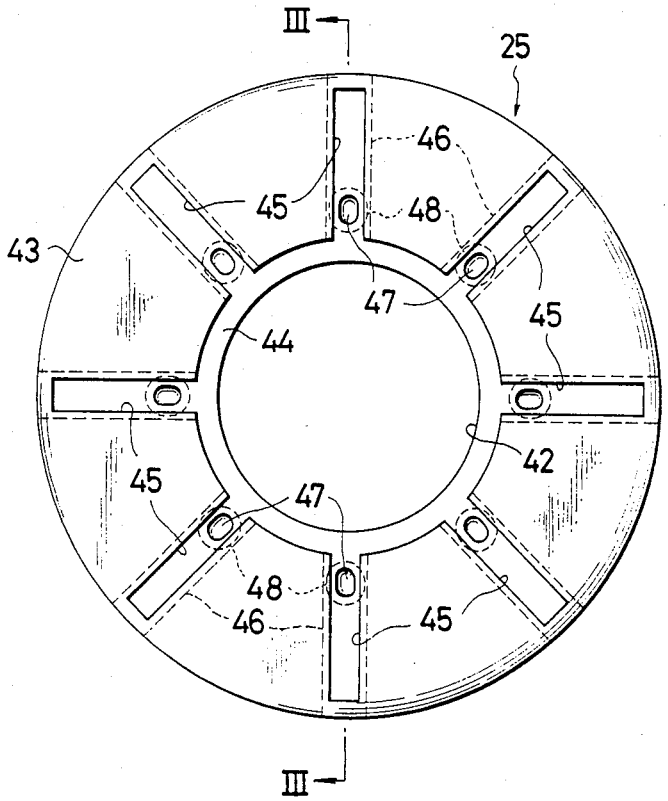
FIG. 2 is a plan view of a reinforcement plate constituting part of the button body shown in FIG. 1.
Figure 3:
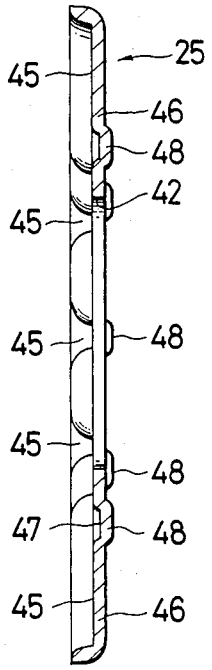
FIG. 3 is a cross-sectional view taken along line III—III of FIG. 2.

As shown in FIGS. 1 through 3, the reinforcement plate 25 has an annular shape including a central aperture 42 and is pressed-formed from a sheet of metal having a thickness smaller than the spacing or distance between the cap 24 and the annular flange 27. The press-formed reinforcement plate 25 is light in weight and can be manufactured at low cost. The annular reinforcement plate 25 has an outside diameter slightly smaller than the inside diameter of the upwardly bent outer peripheral edge 32 of the annular flange 27, and an inside diameter larger than the inside diameter of the annular cap 24. The reinforcement plate 25 includes an annular web portion 43 forming a major part of the reinforcement plate 25 and a recessed narrow annular central portion 44 extending around the aperture 42. The recessed central portion 44 projects downwardly from an inner peripheral edge of the web portion 43 toward the annular ridge 35 of the annular flange 27 and terminate short of the annular ridge 35. The reinforcement plate 25 has a plurality (nine being shown in FIG. 2) of radial grooves 45 extending in an upper surface of the web portion 43 and circumferentially spaced from one another at equal angular intervals, and a corresponding number of reinforcement ribs 46 complementary in contour to the respective grooves 45 and projecting from a lower surface of the web 43. The reinforcement ribs 46 extend radially across the entire width of the web portion 43 and lie in the same plane as the recessed annular central portion 44. Each of the reinforcement ribs 46 is recessed from the back as at 47 so as to provide a protuberance 48 projecting downwardly from the reinforcement rib 46, the protuberance 48 being disposed adjacent to the annular central portion 44. When the cap 24 is clinched with the button back 23 with the reinforcement plate 24 disposed therebetween, as shown in FIG. 1, the upper surface of the annular web portion 43 lies flatwise against the annular land 41 of the cap 24, and the reinforcement ribs 46 and the protuberances 48 are held in engagement with the land 36 and the ridge 35, respectively, of the annular flange 27.

The tack 22 includes a circular head 49 and a shank 50 of a circular cross section projecting coaxially from the center of the circular head 49. The shank 50 having a tapered end portion **50*a*** terminating in a pointed end.

Figure 5:
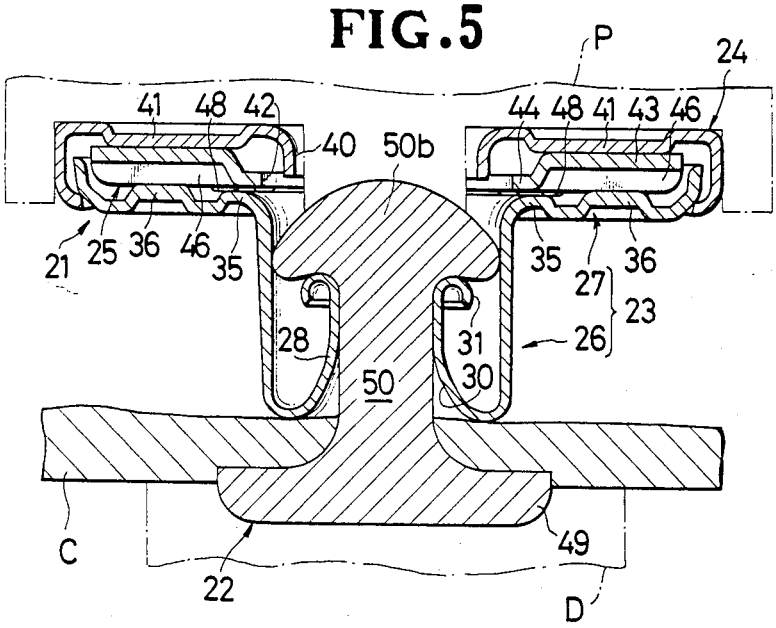
FIG. 5 is an axial cross-sectional view of the button body with the tack inserted and staked therein for attachment to the button body to a garment fabric.
Figure 6:
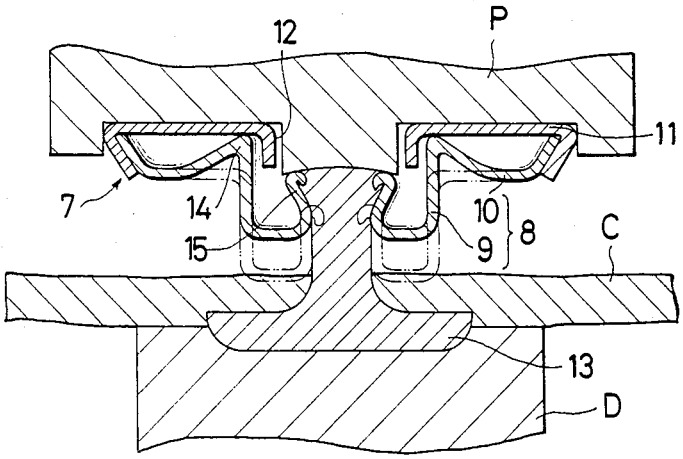
FIG. 6 is an axial cross-sectional view showing a problem of a prior open-faced button.

For attaching the button body 21 to a garment fabric C (FIG. 5) with the tack 22, the shank 50 is forced by a die D to penetrate the garment fabric C and is inserted into the inner tube 28 while the button body 21 is held immovable. At this time, with the reinforcement plate 25 disposed between the cap 24 and the annular flange 27 of the button back 23, the button body 21 has a mechanical strength strong enough to withstand forces tending to deform or bend an inner edge of the annular flange 27 upwardly toward the cap 24. The protuberances 48 held in contact with the ridge 35 are particularly effective to prevent such deformation of the annular flange 27. The tubular stem 26 is held in contact with the garment fabric C and the tapered end portion **50*a* (FIG. 1) extends upwardly beyond the annular rim 31 of the stem 26. Then the tack 22 is axially compressed by and between a punch P and the die D to deform the tapered end portion 50*a* against the punch P into an axially compressed and radially swelled retaining foot 50*b* (FIG. 5) held in interlocking engagement with the annular rim 31 of the inner tube 28**.

Figure 4:
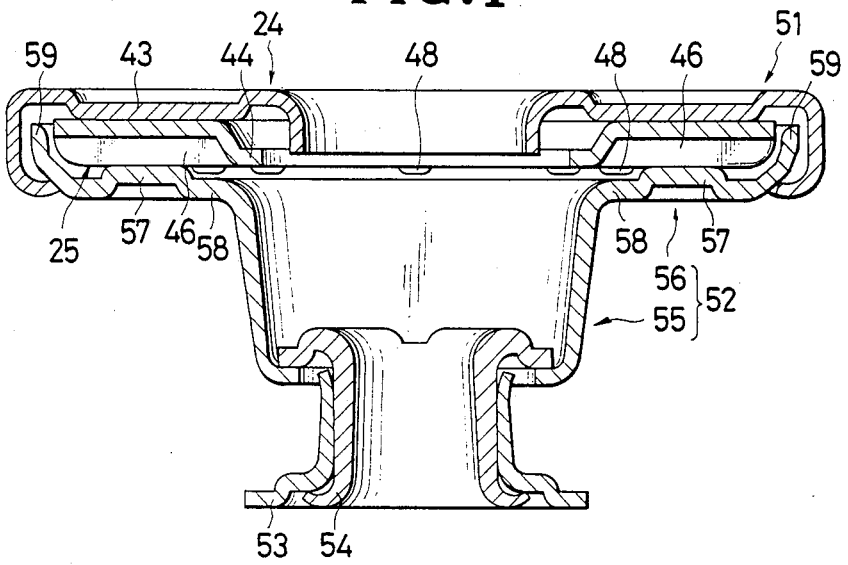
FIG. 4 is an axial cross-sectional view of a modified button body.

A modified button body 51 shown in FIG. 4 is identical with the button body 21 of the foregoing embodiment with the exception that a button back 52 is so constructed as to make the button body 51 rotatable with respect to a tack member, not shown. The button back 52 includes a flanged tubular support 53 firmly fitted around a cylindrical eyelet 54. The eyelet 54 has an upper end received in a single-walled tubular stem 55 of the button back 52 and bent radially outwardly into interlocking engagement with the stem 55. The button back 52 includes an annular flange 56 extending outwardly from an upper end of the tubular stem 55. The annular flange 56 includes an annular land 57 disposed substantially centrally between opposite peripheral edges 58, 59 thereof and held in contact with the reinforcement ribs 46 of a reinforcement plate 25. The protuberances 48 on the respective ribs 46 are normally held out of contact with the inner peripheral edge 58 with a clearance leaving therebetween, however, they are engageable with the inner peripheral edge 58 to prevent upward deformation of the latter when the button body 51 is assembled with the tack in clinched condition.

Obviously, many modifications and varications of the present invention are possible in the light of the above teachings. It is therefore to be understood that within the scope of the appended claims, the invention may be practiced otherwise than as specifically described.

What is claimed is:

1. An open-faced button comprising:

(a) a button body and a tack adapted to be joined with said button body to attach the latter to a garment fabric; and (b) said button body including (1) a button back having a tubular stem for receiving a shank of said tack, and an annular flange extending radially outwardly from one end of said stem, (2) an annular cap mounted on said button back and firmly fitted over an outer peripheral edge of said annular flange, said annular cap having a central aperture, and (3) an annular reinforcement plate disposed between said annular cap and said annular flange for reinforcing said button body to prevent objectionable deformation of said annular flange when said shank is forced into said tubular stem to couple said button body with said tack, said annular reinforcement plate having a central aperture disposed concentrically with said aperture in said annular cap and having a diameter larger than the diameter of said aperture in said annular cap.

2. An open-faced button comprising:

(a) a button body and a tack adapted to be joined with said button body to attach the latter to a garment fabric; and (b) said button body including (1) a button back having a tubular stem for receiving a shank of said tack, and an annular flange extending radially outwardly from one end of said stem, (2) an annular cap mounted on said button back and firmly fitted over an outer peripheral edge of said annular flange, and (3) an annular reinforcement plate disposed between said annular cap and said annular flange for reinforcing said button body to prevent objectionable deformation of said annular flange when said shank is forced into said tubular stem to couple said button body with said tack, said reinforcement plate including a flat annular web portion having one surface held in contact with one of said annular cap and said annular flange, and a plurality of radial reinforcement ribs disposed on the other surface of said web portion and held in contact with the other of said annular cap and said annular flange.

3. An open-faced button according to claim 2, said reinforcement ribs extending radially across the entire width of said annular web portion.

4. An open-faced button according to claim 2, said one surface of said web portion lying flatwise against said annular cap, said reinforcement ribs being held in engagement with said annular flange.

5. An open-faced button according to claim 4, said reinforcement plate further including a recessed annular central portion extending in confronting relation with an inner peripheral edge of said annular flange with a clearance therebetween.

6. An open-faced button according to claim 5, each of said reinforcement ribs including a protuberance projecting outwardly therefrom and disposed adjacent to said annular central portion, said protuberance being held in contact with said inner peripheral edge of said annular flange.

7. An open-faced button according to claim 5, each of said reinforcement ribs including a protuberance projecting outwardly therefrom and disposed adjacent to said annular central portion, said protuberance being held out of contact with said inner peripheral edge of said annular flange with a clearance leaving therebetween.

8. An open-faced button according to claim 2, said reinforcement plate being press-formed from a sheet of metal having a thickness smaller than the spacing between said annular flange and said annular cap.

* * * * *